US010648677B2

(12) United States Patent
Martini et al.

(10) Patent No.: US 10,648,677 B2
(45) Date of Patent: May 12, 2020

(54) FAN FOR OVENS

(71) Applicant: MA. TI.KA. S.R.L., Milan (IT)

(72) Inventors: Oscar Martini, Borgoricco (IT); Enrico Martini, Camposampiero (IT)

(73) Assignee: MA. TI.KA. S.R.L., Milan (IT)

( * ) Notice: Subject to any disclaimer, the term of this patent is extended or adjusted under 35 U.S.C. 154(b) by 176 days.

(21) Appl. No.: 15/992,220

(22) Filed: May 30, 2018

(65) Prior Publication Data

US 2018/0347829 A1 Dec. 6, 2018

(30) Foreign Application Priority Data

May 30, 2017 (IT) ..... 102017000058843

(51) Int. Cl.

| | |
|---|---|
| ***F24C 15/32*** | (2006.01) |
| ***F24C 15/00*** | (2006.01) |
| ***F04D 29/02*** | (2006.01) |
| ***F04D 29/28*** | (2006.01) |

(52) U.S. Cl.

CPC ..... *F24C 15/322* (2013.01); *F04D 29/023* (2013.01); *F04D 29/281* (2013.01); *F04D 29/289* (2013.01); *F24C 15/006* (2013.01); *F05D 2230/54* (2013.01)

(58) Field of Classification Search

CPC .... F04D 29/289; F04D 29/023; F04D 29/281; F04D 17/16; F04D 29/30; F24C 15/006; F24C 15/322; F05D 2230/54; F05D 2240/303; F05D 2250/712; F05D 2250/711; F05B 2250/711; F05B 2250/712

See application file for complete search history.

(56) References Cited

U.S. PATENT DOCUMENTS

| | | | | |
|---|---|---|---|---|
| 10,222,072 | B2 * | 3/2019 | Martini | F04D 17/16 |
| 2015/0285514 | A1 * | 10/2015 | Wie | F24B 1/02 126/21 A |
| 2016/0209028 | A1 * | 7/2016 | Jang | F23D 14/10 |
| 2016/0290355 | A1 | 10/2016 | Lin et al. | |

FOREIGN PATENT DOCUMENTS

| | | |
|---|---|---|
| WO | 2009097340 | 8/2009 |
| WO | 2015140963 | 9/2015 |
| WO | 2016090417 | 6/2016 |

* cited by examiner

*Primary Examiner* — Alfred Basichas
(74) *Attorney, Agent, or Firm* — Mark M. Friedman

(57) ABSTRACT

Fan for ovens, which comprises a support plate and multiple blades projectingly fixed on the support plate and arranged around the rotation axis of the fan. Each blade is provided with a rear edge fixed to the support plate, with an external edge and with an internal edge placed to connect between the rear edge and the external edge and facing the front side of the fan. The fan also comprises a ring fixed to the blades, positioned in a position substantially intermediate between the internal edge of the blades and the support plate in order to create a non-interference zone.

13 Claims, 6 Drawing Sheets

FAN FOR OVENS

FIELD OF APPLICATION

The present invention regards a fan for ovens.

The present fan is inserted in the field of production of ovens and of oven components, which are intended to be advantageously used in the food field for preparing foods.

Such ovens, in particular, are intended to be used in a professional setting, for example in the restaurant, gastronomy, pastry and bakery fields.

STATE OF THE ART

Ovens for professional use are known on the market, which conventionally comprise a load-bearing structure with box-like shape that at its interior delimits a cooking chamber, in which the foods to be cooked are intended to be introduced.

More in detail, the load-bearing structure comprises a lower wall, an upper wall and two lateral walls, which delimit the aforesaid cooking chamber between them. The load-bearing structure also comprises a bottom wall placed as a rear closure of the cooking chamber.

The load-bearing structure is provided on the front with an access opening to the cooking chamber in order to allow the introduction of the foods to be cooked in the cooking chamber and to extract such foods therefrom at the end of cooking. A door is provided that is hinged to the load-bearing structure and actuatable for closing the access opening during the cooking of the foods.

The oven also comprises heating means adapted to heat the air within the cooking chamber, and a fan (in particular of centrifugal type) arranged within the cooking chamber and actuatable for generating a flow of hot air that circulates in the cooking chamber itself in order to uniformly cook the foods.

More in detail, the fan is positioned at the bottom wall of the load-bearing structure and is fixed to a horizontal rotation shaft mechanically connected to an electric motor actuatable for rotating the fan itself.

The heating means of the oven generally comprise an electrical heating element of circular shape and arranged around the fan, or radiant tubes traversed by high-temperature gases arranged on the side of the fan, in order to heat the air flow generated by the fan itself.

In particular, fans for ovens are known which comprise a support disc provided with a central hub fixed to the rotation shaft and bearing a plurality of blades thereon that are radially arranged around the rotation shaft itself.

More in detail, each blade has substantially plate-like shape and is extended parallel to the rotation shaft between a rear edge thereof, fixed to the support disc, and a front edge thereof fixed to a frontal ring that delimits a central opening of the fan.

In operation, when the fan is rotated, it axially suctions the air through the central opening of the frontal ring, and radially expels the pressurized air through the openings between the blades, in a manner such that the air flow intercepts the electrical heating element, absorbing the heat thereof, and is then propagated within the cooking chamber in order to bring the heat to the foods to be cooked.

In practice, the fans for ovens of known type briefly described up to now have demonstrated that they do not lack drawbacks.

A first drawback lies in the fact that the making of the support disc and the frontal ring of the fan is achieved by means of a shearing process executed on separate working plates, involving the use of high quantities of raw material and the production of considerable waste material, with consequent high costs for producing the fan.

A further drawback lies in the fact that such fan has high inertia due to the presence of the frontal ring, which represents a considerable mass arranged peripherally with respect to the fan, therefore requiring high energy consumption by the electric motor in order to rotate the fan.

In order to cook foods by means of the aid of vapor, ovens for cooking foods for professional use are known on the market that in technical jargon are termed combined steam ovens, provided with (in addition to heating means and at least one fan) water vapor production means, in order to increase the humidity within the cooking chamber of the oven during the cooking of the foods.

More in detail, the combined steam ovens are provided with water vapor production means, which spray a quantity of water frontally on the blades of the fan which determine the atomization thereof following the impact force with the blades themselves. Then, the heating means transform the atomized water drops present in the air moved by the fans into water vapor.

A temperature sensor is normally provided for detecting the temperature of the air in the cooking chamber.

Such combined steam ovens of known type have the drawback of not being able to carry out an accurate measurement of the actual temperature of the air circulating in the cooking chamber, not allowing the efficient control of the turning on of the electrical heating elements of the heating means in order to maintain the temperature of the cooking chamber.

More in detail, it is not possible to position a temperature sensor at the fan since the vapor production means could also spray water on the sensor, distorting the temperature read by the sensor.

In order to overcome this drawback, in practice, the temperature sensor is placed in the cooking chamber, downstream of the electrical heating elements, with the drawback of only reading a local temperature value and not the temperature value of the air that circulates throughout the entire cooking chamber. In addition, in this manner, the value read by the sensor is the temperature of an air flow that has already been heated by the electrical heating elements and, therefore, does not allow knowing the temperature of the air suctioned by the fan, not allowing an accurate adjustment of such temperature. Known from the patent applications WO 2015/140963 and WO 2016/090417 are fans for air conditioning plants, which are provided with a perimeter ring fixed on the external edge of the blades and arranged between the front side and the rear side of the fan.

The latter fans of known type are not adapted to be employed in ovens for cooking foods, since they lack sufficient structural strength for resisting the mechanical and thermal stresses to which the fans for ovens are generally subjected. In addition, such fans of known type would not in any case allow arranging operating elements of the oven (such as a temperature sensor) at the fans themselves, and therefore they would not allow resolving the abovementioned problems.

PRESENTATION OF THE INVENTION

In this situation, the problem underlying the present invention is therefore that of overcoming the drawbacks set forth by providing a fan for ovens capable of ensuring an efficient operation of the oven.

A further object of the present invention is to provide a fan for ovens that is structurally light and which ensures a low energy consumption.

A further object of the present invention is to provide a fan for ovens that is entirely reliable in operation.

BRIEF DESCRIPTION OF THE DRAWINGS

The technical characteristics of the invention, according to the aforesaid objects, are clearly found in the contents of the below-reported claims and the advantages thereof will be more evident from the following detailed description, made with reference to the enclosed drawings, which represent several merely exemplifying and non-limiting embodiments of the invention, in which:

DETAILED DESCRIPTION OF A PREFERRED EMBODIMENT

With reference to the enclosed drawings, reference number 1 overall indicates a fan, object of the present invention.

Advantageously, the present fan 1 is adapted to be installed in an oven 100 which, in particular, is intended to be employed in a professional setting, for example in the restaurant, gastronomy, pastry and bakery fields.

Figure 5:
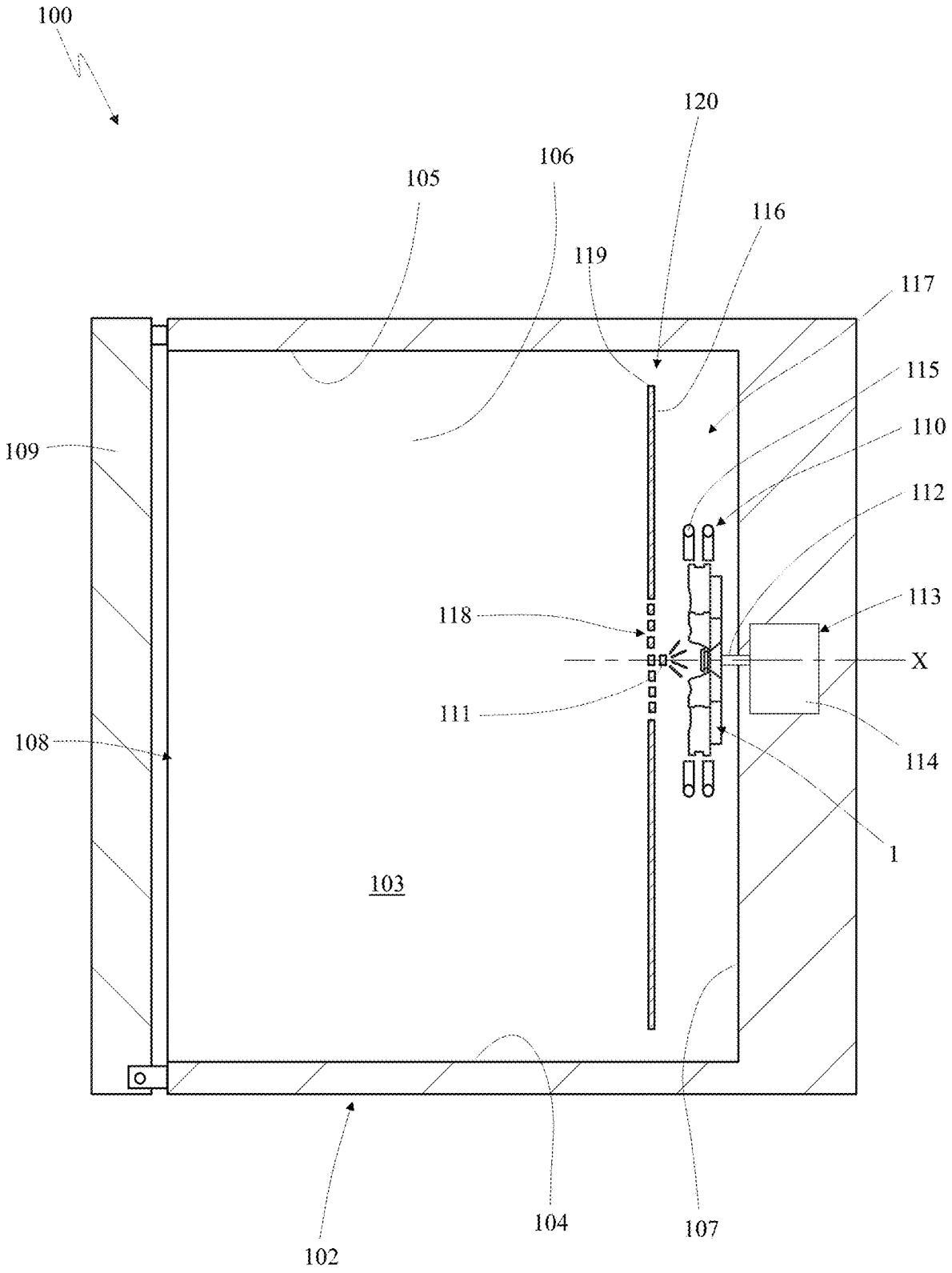
FIG. 5 illustrates a schematized side section view of an example of an oven for cooking foods in which the fan, object of the present invention, is intended to be mounted.

With reference to the embodiment illustrated in FIG. 5, the oven 100 comprises a support structure 102 that encloses a cooking chamber 103 within which the foods to be cooked are intended to be arranged.

Preferably, the support structure 102 has box-like shape and comprises a lower wall 104 and an upper wall 105 parallel to and facing each other, and two lateral walls 106 placed to connect the upper and lower walls 104 and 105. Such walls 104, 105, 106 delimit the aforesaid cooking chamber 103 between them.

The support structure 102 of the oven 100 also comprises a bottom wall 107 fixed to the upper, lower and lateral walls 104-106 as a rear closure of the cooking chamber 103.

The support structure 102 is provided with an access opening 108 to the cooking chamber 103, and such opening 108 is preferably positioned opposite the bottom wall 107 of the support structure 102 itself.

Advantageously, the oven 100 comprises a door 109 which is hinged to the support structure 102 and is movable between a closed position, in which it obstructs the access opening 108, and an open position, in which the access opening 108 is free of the door 109 in order to allow the introduction and extraction of the foods into and from the cooking chamber 103.

The oven 100 comprises at least one heating device 110 mounted on the support structure 102, in operation associated with the cooking chamber 103, and actuatable for heating the air within the latter, in order to cook the foods arranged within the cooking chamber 103 itself.

The fan 1, object of the present invention, is intended to be arranged within the cooking chamber 103 of the oven 100, and is actuatable for generating, within such chamber 103, a recirculation air flow adapted to uniformly distribute the hot air within the cooking chamber 103 itself.

In particular, the fan 1 is intended to be arranged within the cooking chamber 103 of the oven 100 at one of the walls 104-107 of the support structure 102 and, preferably, at the bottom wall 107.

Advantageously, the fan 1 is adapted to be fixed to a rotation shaft 112 rotatably constrained to the support structure 102 and arranged in particular to cross the bottom wall 107 with axis orthogonal to the latter.

The oven 100 is provided with movement means 113 preferably comprising an electric motor 114, which is mechanically connected to the rotation shaft 112 and is actuatable to rotate the latter in order to move the fan 1.

Advantageously, the oven 100 is provided with at least one vapor production device 111 arranged frontally with respect to the fan 1 and adapted to spray a quantity of water on the blades of the fan 1 itself.

In accordance with the embodiment illustrated in FIGS. 1-3B, the fan 1, preferably of centrifugal type, is provided with a rotation axis X thereof, which is advantageously intended to be arranged aligned with the rotation shaft 112, and around which the fan 1 is actuatable to rotate by the aforesaid movement means 113.

According to the invention, the fan 1 is extended along the aforesaid rotation axis X between a front side 2 and a rear side 3 directed in opposite directions with respect to each other, and is provided with a peripheral side 4, which is extended around the rotation axis X between the front side 2 and the rear side 3.

More in detail, the fan 1 comprises a support plate 5 placed to at least partially close the rear side 3 of the fan 1 itself.

According to the embodiment illustrated in the enclosed figures, the support plate 5 substantially lacks openings for the passage of air, therefore allowing the suction of air only from the front side 2 of the fan 1.

In accordance with a different non-illustrated embodiment, the support plate 5 of the fan 1 is provided with one or more through openings for allowing the suction of air also from the rear side 3 of the fan 1 itself.

The support plate 5 of the fan 1 is arranged substantially orthogonal to the rotation axis X and is provided with a first face 6, which delimits the rear side 3 of the fan 1, and with a second face 7 directed towards the front side 2 of the fan 1 itself.

The fan 1 also comprises multiple blades 8 projectingly fixed on the second face 7 of the support plate 5 and arranged around the rotation axis X.

In accordance with the embodiment illustrated in the enclosed figures, the support plate 5 of the fan 1 has preferably substantially circular shape, with center aligned with the rotation axis X and is provided with a perimeter profile 50 along which the blades 8 of the fan 1 itself are arranged and having a first external diameter D1.

In particular, the support plate 5 bears, centrally fixed thereto, a hub 10 which is intended to be fixed to the rotation shaft 112 actuatable for moving the fan 1.

Advantageously, the blades 8 of the fan 1 are arranged around the rotation axis X equidistant from the latter, preferably along a circular trajectory, and are in particular regularly distributed around the rotation axis X itself.

Advantageously, the blades 8 of the fan 1 have substantially plate-like shape, being in particular extended orthogonal to the second face 7 of the support plate 5.

Advantageously, the extension planes of the blades 8 are arranged parallel to the rotation axis X and are radially positioned with respect to the latter.

In accordance with a different embodiment of the present invention not illustrated in the enclosed figures, the blades 8 might not have substantially flat shape, having for example curved shape.

Preferably, the blades 8 are separated from each other by delivery openings 14 made along the peripheral side 4 of the fan 1, and through such delivery openings 14 the air is radially blown under pressure into the cooking chamber 103, as described in detail hereinbelow.

For example, the fan 1 comprises a number of blades 8 comprised between three and eight.

In addition, the fan 1 comprises a ring 9, which is fixed to the blades 8, is extended around the rotation axis X, and is provided with a third face 11 directed towards the rear side 3 of the fan 1, and with a fourth face 12 directed towards the front side of the fan 1 itself.

The ring 9 is preferably parallel to the support plate 5.

In accordance with the embodiment illustrated in FIGS. 1-3B, the ring 9 of the fan 1 substantially has the shape of a circular crown, with center aligned with the rotation axis X and concentric with the support plate 5. Advantageously, the ring 9 is provided with an external profile 92 having a second external diameter D2, and with an internal profile 93 which delimits an internal opening 94 of the circular crown and has an internal diameter D3 greater than or equal to the first internal diameter D1 of the perimeter profile 50 of the support plate 5 and, preferably, equal to the first internal diameter D1 of the perimeter profile 50 of the support plate 5.

Such advantageous configuration of the support plate 5 and of the ring 9 allows economical, construction and structural advantages, in particular in terms of cost of production and weight of the fan, as discussed in detail hereinbelow.

Suitably, the support plate 5, the blades 8 and the ring 9 of the fan 1 are made of metallic material, in particular of stainless steel.

Of course, without departing from the scope of the present patent, the fan 1 can be made of any other material suitable for the operating conditions in which the fan 1 itself is intended to operate. For example, the fan 1 can also be made of plastic material, in particular if employed in an oven adapted to cook foods at low temperature.

Advantageously, the fan 1 is arranged within the cooking chamber 103 of the oven 100 with its rear side 3 substantially adjacent and parallel to one of the walls 104-107 of the support structure 102. In particular, in accordance with the embodiment illustrated in FIG. 5, the fan 1 is arranged with its rear side 3 directed towards the bottom wall 107 of the support structure 102 and with its front side 2 directed towards the access opening 108.

Advantageously, the fan 1 is positioned with its rear side 3 adjacent to the bottom wall 107.

In operation, the fan 1, when it is rotated by means of the driving of the movement means 113, suctions an air flow from the cooking chamber 103 through the open front side 2 of the fan 1 itself, and radially expels the air from the peripheral side 4 thereof through the delivery openings 14.

Advantageously, the heating device 110 of the oven 100 comprises at least one electrical heating element 115 with substantially circular shape and arranged around the peripheral side 4 of the fan 1, so as to intercept the air that exits under pressure from the delivery openings 14 of the fan 1 itself, in order to transfer the heat to the air so to heat it.

In accordance with a different embodiment not illustrated in the enclosed figures, the electrical heating element of the heating device 110 can also have different shape and/or position, being arranged for example in front of the front side 2 of the fan 1.

In accordance with a further different embodiment, the heating device 110 are of gas type, comprising for example multiple radiant tubes on the side of the fan 1 and susceptible of being traversed by high-temperature gas fed by a burner.

Advantageously, the oven 100 comprises a fan screen 116 arranged within the cooking chamber 103 and positioned in front of the front side of the fan 1, in a manner such to delimit (in the cooking chamber 103), with the bottom wall 107 of the support structure 102, an interspace 117 within which the fan 1 itself is positioned. Such fan screen 116 is in particular arranged between the fan 1 and a space of the cooking chamber 103 in which the foods to be cooked are intended to be arranged.

Advantageously, the fan screen 116 is arranged substantially orthogonal to the rotation axis X of the fan 1, and is provided with multiple passage openings 118 positioned in front of the front side 2 of the fan 1 itself, so as to allow the latter to suction air from the space of the cooking chamber 103.

The fan screen 116 is provided with an external edge 119 which delimits, with the lower 104, upper 105 and lateral 106 walls of the oven 100, at least one slit 120 through which the air flow generated in delivery from the fan 1 exits from the interspace 117 in order to be distributed within the space of the cooking chamber 103 in which the foods to be cooked are arranged. In particular, such air flow, which exits from the interspace 117, hits the lower 104, upper 105 and lateral walls 106 of the oven 100, and flows towards the center of the cooking chamber 103, being once again suctioned by the fan 1, so as to generate an air circulation within the cooking chamber 103.

Advantageously, the vapor production device 111 comprises at least one channel for distributing the water provided with a dispensing mouth positioned frontally with respect to the fan 1 and preferably positioned between the fan screen 116 and the fan 1, in order to spray a quantity of water on the front side 2 of the fan 1 itself.

Figure 4:
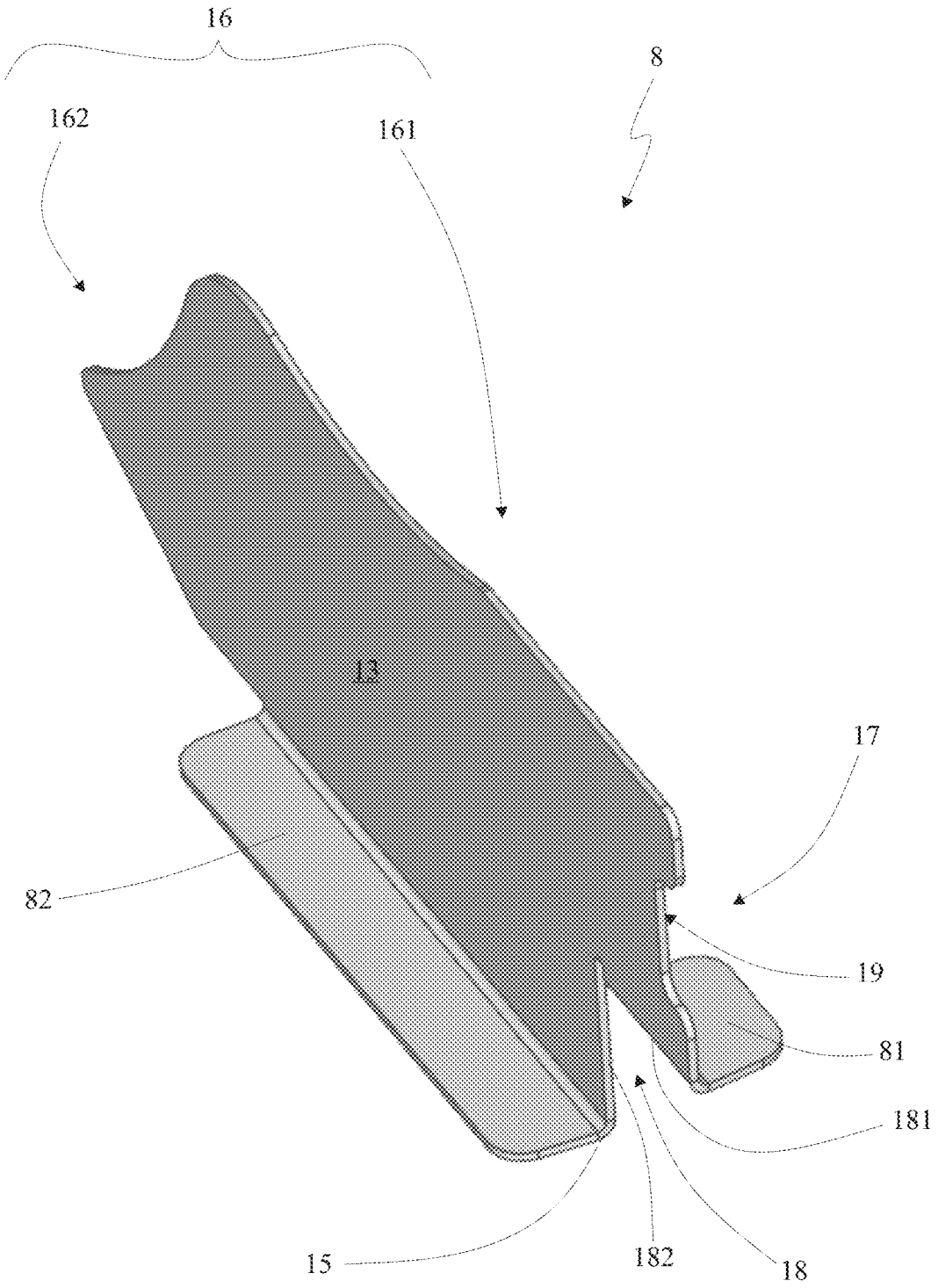
FIG. 4 shows a perspective view of a detail of the present fan, relative to a blade of the fan itself.

With reference to the embodiment illustrated in FIG. 4, each blade 8 of the fan 1 is provided with two faces 13 that are parallel to each other and directed in opposite directions with respect to each other.

In addition, each blade 8 is provided with a rear edge 15 fixed to the second face 7 of the support plate 5, with an external edge 17 arranged on the peripheral side 4 of the fan 1, and with an internal edge 16 placed to connect between the rear edge 15 and the external edge 17 and facing the front side 2 of the fan 1.

Preferably, the internal edge 16 of each blade 8 is provided with a first portion 161 substantially parallel to the rear edge 15 and substantially perpendicular to the external edge 17 of the blade 8 itself, and with a second portion 162 of connection between the first portion 161 and the rear edge 15.

The ring 9 of the fan 1 is positioned in a position substantially intermediate between the internal edges 16 of the blades 8 and the support plate 5 of the fan 1 itself.

With the term "intermediate" it is intended hereinbelow any one position situated along the rotation axis X between the first face 6 of the support plate 5 and the first portion 161 of the internal edges 16 of the blades 8.

Figure 1:
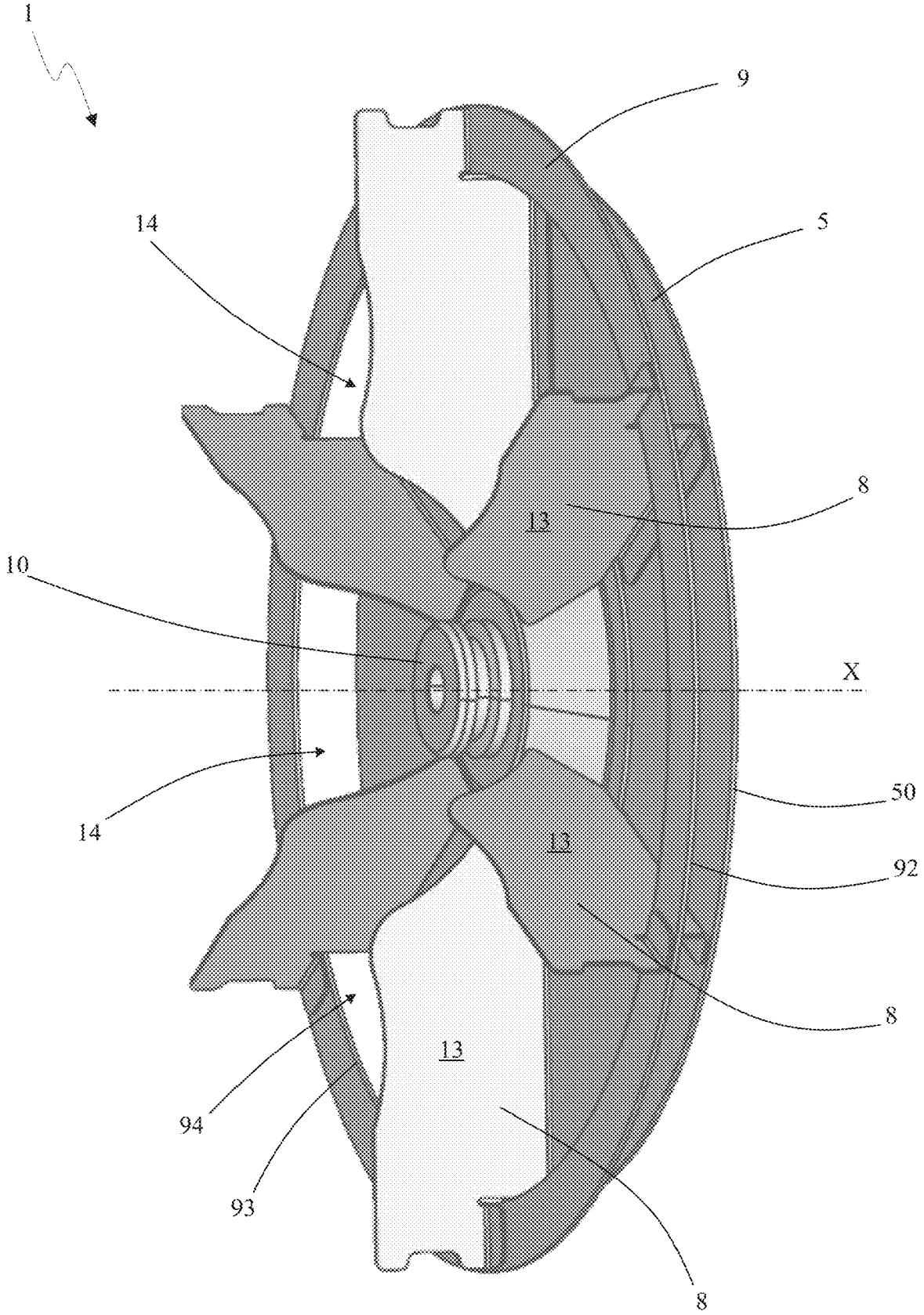
FIG. 1 illustrates a perspective view of the fan, object of the present invention.
Figure 2:
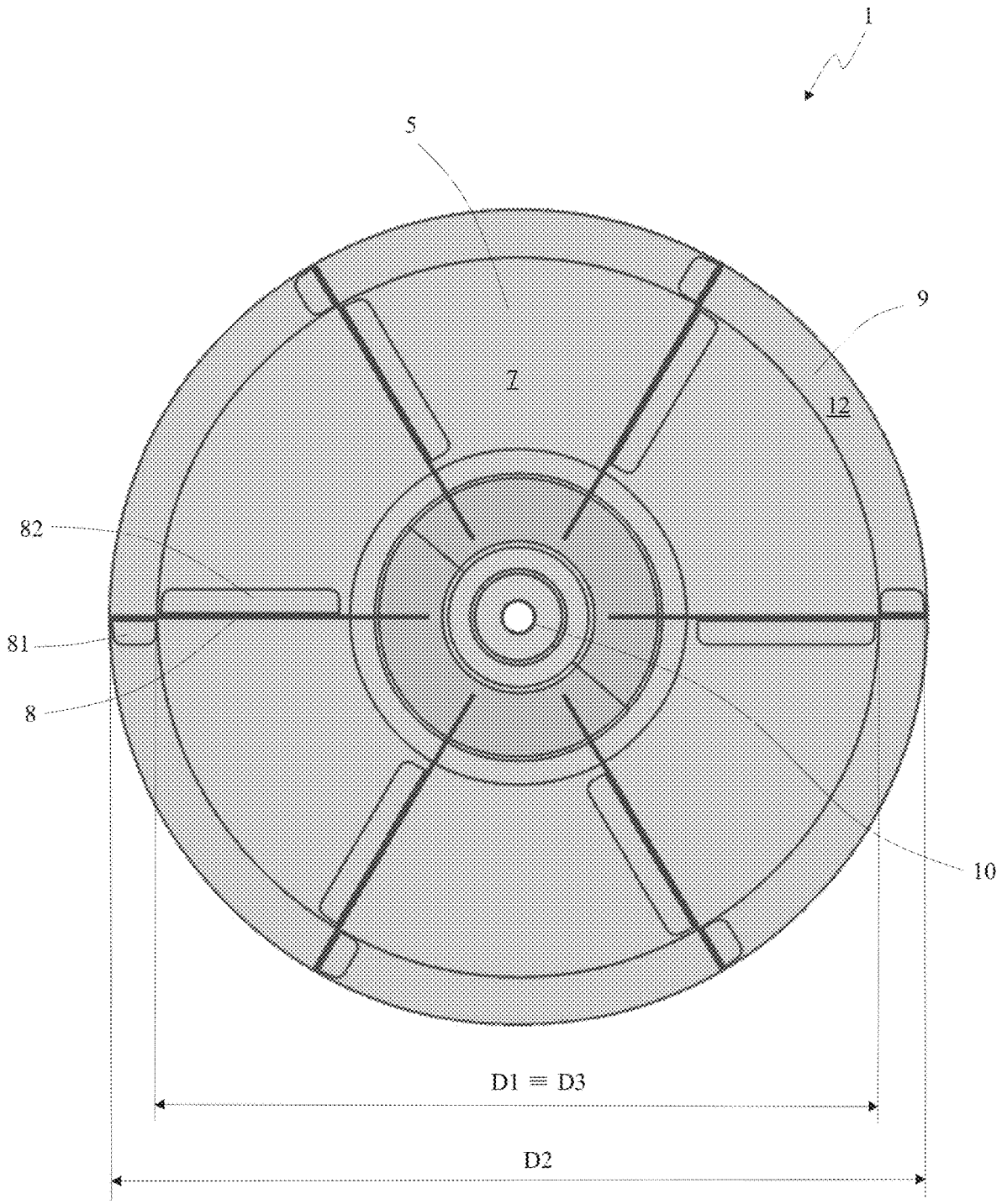
FIG. 2 shows a front view of the fan, object of the present invention.
Figure 3A:
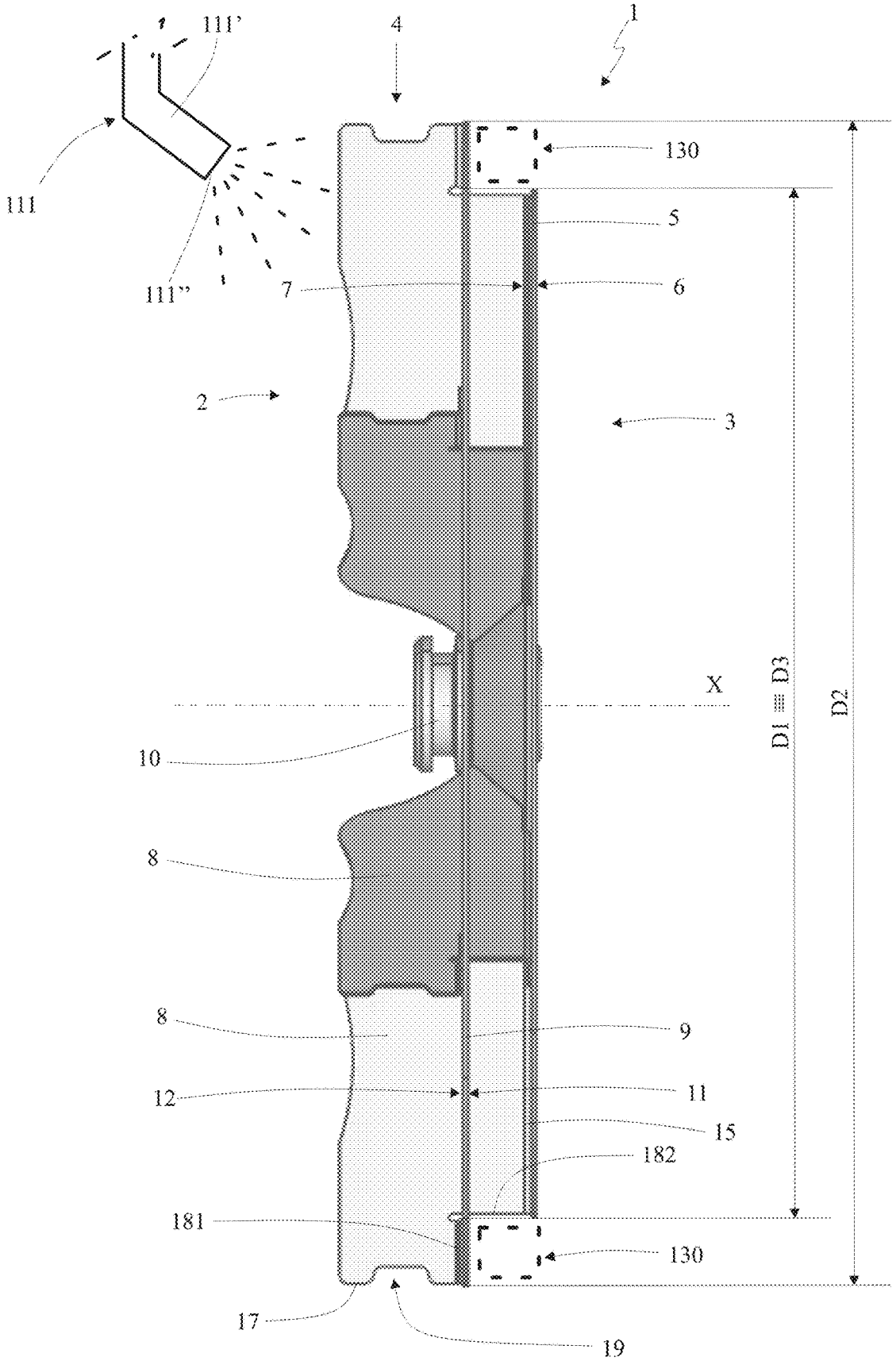
FIG. 3A shows a side view of the fan, object of the present invention, in a first configuration within an oven.
Figure 3B:
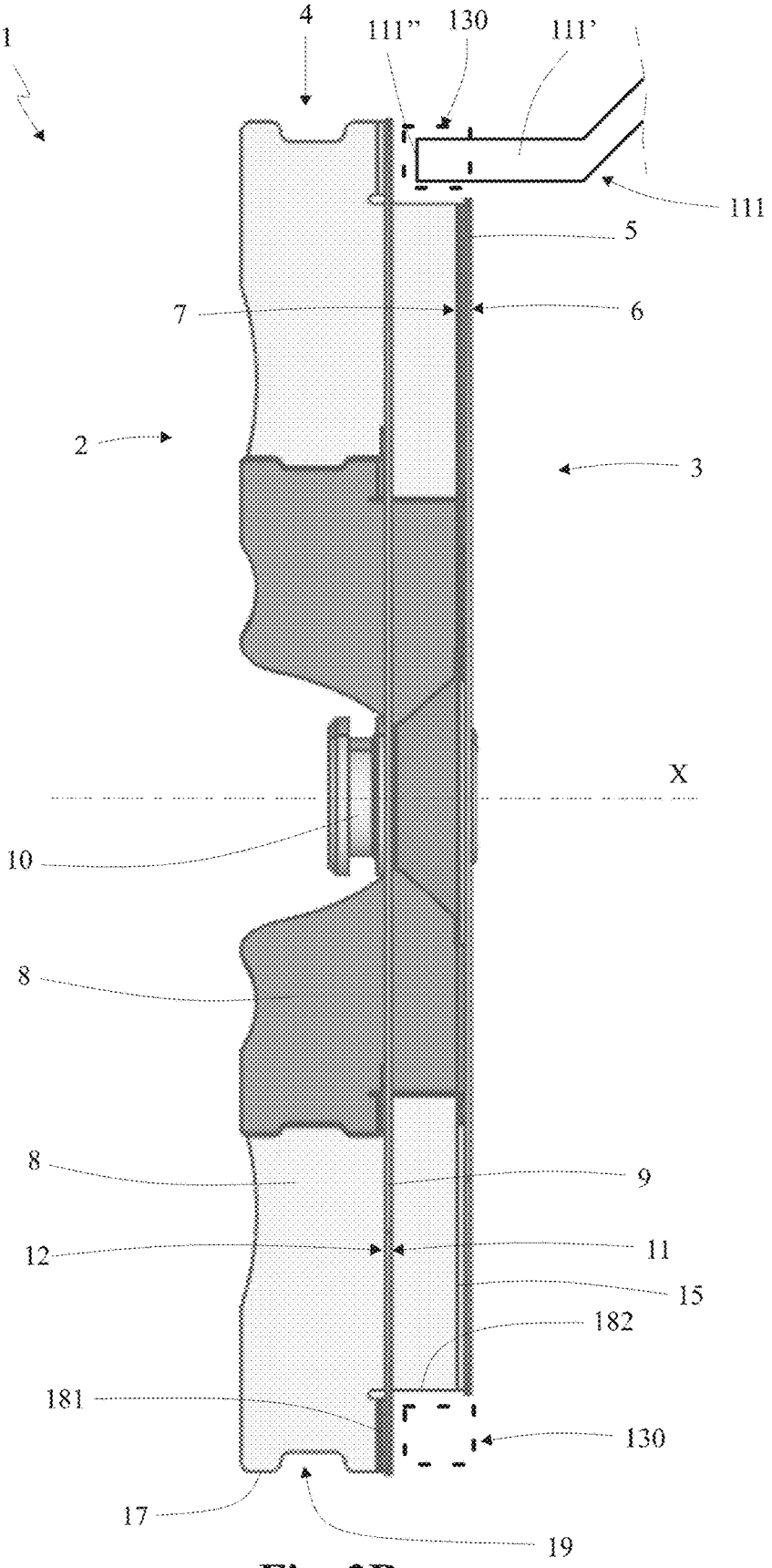
FIG. 3B shows a side view of the fan, object of the present invention, in a second configuration within an oven.

Advantageously, in accordance with the embodiment illustrated in FIGS. 3A and 3B, the ring 9 is arranged closer to the support plate 5 with respect to the internal edge 16 of each blade 8 and preferably is placed spaced from the support plate 5 by about ⅓ of the distance between the support plate 5 and the internal edge 16.

According to the idea underlying the present invention, the external edge 17 of each blade 8 is provided with a recess 18, which is open on the peripheral side 4 and on the rear side 3 of the fan 1 and in which the ring 9 is fixed.

The recesses 18 of the blades 8 define a non-interference zone 130 which is extended between the rear side 3 of the fan 1 and the third face 11 of the ring 9.

Advantageously, each blade 8 is provided with a first recess edge 181 and with a second recess edge 182, which delimit the recess 18 of the blade 8 itself.

More in detail, the first recess edge 181 is extended from the external edge 17 of the corresponding blade 8 towards the rotation axis X of the fan 1, and the second recess edge 182 is extended from the rear edge 15 of the blade 8 until it is joined to the first recess edge 181, preferably at an internal vertex of the recess 18.

In this manner, the recess 18 of each blade 8 is extended, parallel to the rotation axis X, from the rear edge 15 of the blade 8 to the first recess edge 181, and is extended, orthogonal to the rotation axis X, from the external edge 17 of the blade 8 to the said second recess edge 182.

Advantageously, the recess 18 is arranged as a connection between the external edge 17 and the rear edge 15 of the corresponding blade 8, in this manner defining a recessed angle of the blade 8, arranged at the connection of the rear side 3 of the fan 1 with the peripheral side 4 of the latter.

Preferably the recess 18 of each blade 8 is shaped as a step, in particular at right angle. More in detail, the first recess edge 181 of each blade 8 is substantially parallel to the rear edge 15 of the blade 8 and substantially perpendicular to the external edge 17 of the latter, and the second recess edge 182 is substantially parallel to the external edge 17 of the blade 8 and substantially perpendicular first recess edge 181.

In particular, the first recess edge 181 is orthogonal to the rotation axis X, and the second recess edge 182 is parallel to the rotation axis X itself and is joined at right angle with the first recess edge 181.

Preferably, the second recess edge 182 is arranged at the perimeter profile 50 of the support plate 5 of the fan 1, preferably substantially flush with such perimeter profile 50.

Advantageously, the fourth face 12 of the ring 9 of the fan 1 is fixed to the first recess edge 181 of the blades 8, while the third face 11 of the ring 9 faces the recess 18, delimiting (towards the frontal side 2 of the fan 1) the aforesaid non-interference zone 130.

Advantageously, each blade 8 is provided, at the corresponding recess 18, with a first bent fin 81, which is preferably extended from the first section 181 of the recess 18 and is bent, in particular at right angle, with respect to the faces 13 of the blade 8, in a manner such to be substantially parallel to the support plate 5 of the fan 1.

Such first bent fin 81 is fixed on the fourth face 12 of the ring 9, for example by means of caulking and/or welding and/or electric welding and/or riveting, etc.

Preferably, the rear edge 15 of each blade 8 delimits a second bent fin 82, which is bent, in particular at right angle, with respect to the faces 13 of the blade 8 and is fixed to the second face 7 of the support plate 5, for example by means of caulking and/or welding and/or electric welding and/or riveting, etc.

More in detail, the ring 9 is fixed to the blades 8 to intercept the external edge 17 of each blade 8 and in particular with its external profile 92 flush with the external edge 17 of the blades 8.

Advantageously, the non-interference zone 130 delimited by the third face 11 of the ring 9, indicated in the examples of FIGS. 3A and 3B with a dashed square, is situated at a volume with substantially toroidal shape defined by the rotation around the rotation axis X of a generatrix determined by the profile of the recess 18 of each blade 8.

In operation, with reference to the example of FIG. 3A, the prearrangement of the ring 9 in the recesses 18 of the blades 8 in intermediate position between the internal edges 22 of the blades 8 and the support plate 5, according to the present invention, has the technical effect of allowing the division of the air flow moved by the blades 8 from the water flow sprayed by the vapor production device 111 (arranged frontally with respect to the fan 1), protecting the non-interference zone 130 from water.

In this manner, in particular, the non-interference zone 130 of the fan 1 is subjected to the passage of an air flow moved by the blades 8 of the fan 1 itself and simultaneously is protected from the water quantity sprayed by the vapor production device 111 (arranged frontally with respect to the fan 1).

Advantageously, still with reference to the example of FIG. 3A, in such non-interference zone 130 a sensor can be placed for detecting several parameters of the air moved by the fan 1. In particular a temperature sensor can be placed, which is able to measure the temperature values of an air flow not disturbed by the water sprayed by the vapor production device 111 and simultaneously not yet heated by the heating elements 115 of the heating device 110.

In particular, the ring 9 in the intermediate position intercepts the water flow coming from the vapor production device 111 (arranged frontally with respect to the fan 1), protecting the non-interference zone 130 and, therefore, preventing water from coming into contact with the temperature sensor. In this manner the measurements of the temperature sensor are not distorted by water, which generally has lower temperatures than the air in the cooking chamber 103 of the oven 100.

Therefore the temperature sensor is able to detect a very precise measurement of the temperature of the air flow, allowing the effective control of the turning on of the electrical heating elements 115 of the heating device 110 in order to carry out an accurate adjustment of the temperature in cooking chamber 103.

Advantageously, with reference to the example of FIG. 3B, in the non-interference zone 130, the vapor production device 111 is placeable comprising for example a conveyance tube 111' provided with a dispensing mouth 111". In particular, such dispensing mouth 111" is arranged in the non-interference zone 130, in a manner such that, during the rotation of the fan 1, it crosses the recesses 18 of the blades 8 without interfering with the rotation of the fan 1 itself.

In particular, the dispensing mouth 111" of the conveyance tube 111' is directed towards the third face 11 of the ring 9, in a manner such that, during the operation of the oven 100, the water dispensed by the dispensing mouth 111" comes to smash against such third face 11 of the ring 9, being atomized in order to be radially ejected from the peripheral side 4 of the fan 1.

Advantageously, moreover, the non-interference zone 130 of the fan 1 is subjected, due to the speed of the air flow that exits through the delivery openings 14 between the blades 8, to a reduced pressure adapted to draw air from the zone behind the first face 6 of the support plate 5 of the fan 1 (in particular between the support plate 5 and the bottom wall 107 of the oven 1), conveying such air with the air flow exiting from the delivery openings 14 of the fan 1.

Advantageously, the external edge 17 of each blade 8 is provided with an outflow concavity 19, which is preferably arranged between the internal edge 16 and the recess 18 of the blade 8 itself.

The outflow concavity 19 is made for the purpose of facilitating the separation of the air flow moved by the blade 8 itself at the delivery openings 14 along the peripheral side 4 of the fan 1.

A method for making a fan 1 for ovens of the above-described type is described in the following, and hereinbelow for the sake of simplicity, the same reference nomenclature will be employed.

The method according to the invention comprises a step of prearranging a metallic plate and preferably a stainless steel plate.

Hence at least one first step of cutting the metallic plate is provided, for example by shearing or by means of a laser cutting, in which at least one base disc is obtained provided with a peripheral profile with preferably circular shape.

Subsequently, at least one second step of cutting the base disc is provided, for example by shearing or by means of laser cutting, in which the base disc is divided into a support plate 5 and a ring 9, both concentric with the base disc itself.

More in detail the support plate 5 thus obtained has substantially circular shape and is provided with a perimeter profile 50 having a first external diameter D1.

In addition, the ring 9 thus obtained has substantially circular crown shape and is provided with an internal profile 93 which delimits an internal opening 94 and has internal diameter D3 equal to the first external diameter D1 of the support plate 5. In addition, the ring 9 is provided with an external profile 92 corresponding to the peripheral profile of the base disc and provided with a second external diameter D2. In this manner, from only one metallic plate, and more in detail from only one base disc, it is possible to simultaneously make the support plate 5 and the ring 9 with a consequent raw material and waste savings.

The method according to the invention also comprises a step of making a plurality of blades 8, each of which provided with a rear edge 15, with an external edge 17 and with an internal edge 16 placed to connect between the rear edge 15 and the external edge 17. Advantageously, the step of forming the blades 8 provides for making, for each blade 8, a recess 18 on the external edge 17.

Advantageously, moreover, the step of forming the blades 8 provides for making, for each blade 8, a first bent fin 81, in particular at right angle at the external edge 17 and preferably a second bent fin 82, in particular at right angle, at the rear edge 15.

The method according to the invention subsequently comprises a first step of fixing the rear edge 15 of each blade 8 to the support plate 5 along the rear edge 8.

More in detail, the first fixing step provides for fixing the second bent fin 82 of each blade 8 to the second face 7 of the support plate 5, for example by means of caulking and/or welding and/or electric welding and/or riveting, etc.

The method according to the invention also comprises a second step of fixing the ring 9 to the blades 8 in a position substantially intermediate between the internal edge 16 of the blades 8 and the support plate 5.

More in detail, the second fixing step provides for fixing the ring 9 in the recesses 18 of the blades 8 and preferably provides for fixing the ring 9 to the first bent fin 81 of each blade 8 by means of caulking and/or welding and/or electric welding and/or riveting, etc.

The invention and the method thus described therefore attain the pre-established objects. In particular, the ring 9 arranged in the recesses 18 of the blades 8 in intermediate position, according to the invention, allows arranging suitable operating elements of the oven 100 (such as a temperature sensor or vapor production means) very close to the ring 9 without interfering with the rotation of the fan 1.

In particular, the ring 9 allows protecting the back non-interference zone 130 from water, allowing the prearrangement in such non-interference zone 130 of a temperature sensor capable of accurately detecting the air temperature, as stated above.

In addition, the prearranging of the support plate 5 with the first external diameter D1 less than or equal to the internal diameter D3 of the ring 9 involves reduced dimensions of the support plate 5 itself, ensuring limited weight and inertia of the blade, and consequently requiring a limited quantity of energy by the electric motor 114 in order to rotate the fan 1.

In addition, the present production method, by obtaining the ring 9 and the support plate 5 from a single metallic plate, allows a considerable savings of raw material with respect to the conventional production techniques.

What is claimed is:

1. Fan (1) for ovens, which is provided with a rotation axis (X) thereof and is extended along said rotation axis (X) between a front side (2) and a rear side (3) directed in opposite directions with respect to each other, and is provided with a peripheral side (4) which is extended around said rotation axis (X) between said front side (2) and said rear side (3);

said fan (1) comprising:

a support plate (5) which is arranged substantially orthogonal to said rotation axis (X) and is provided with a first face (6), which delimits the rear side (3) of said fan (1), and with a second face (7) directed towards the front side (2) of said fan (1);

multiple blades (8) projectingly fixed on the second face (7) of said support plate (5) and arranged around said rotation axis (X);

each said blade (8) being provided with:

a rear edge (15) fixed to the second face (7) of said support plate (5);

an external edge (17) arranged on the peripheral side (4) of said fan (1);

an internal edge (16) placed to connect between said rear edge (15) and said external edge (17) and facing the front side (2) of said fan (1);

a ring (9) which is fixed to said blades (8), is extended around the rotation axis (X) of said fan (1), is provided with a third face (11) directed towards the rear side (3) of said fan (1) and with a fourth face (12) directed towards the front side (2) of said fan (1); and is positioned in a position substantially intermediate between the internal edge (16) of said blades (8) and said support plate (5);

wherein the external edge (17) of each said blade (8) is provided with a recess (18) which is open on the peripheral side (4) and on the rear side (3) of said fan (1) and in such recess (18) said ring (9) is fixed;

wherein the recesses (18) of said blades (8) define a non-interference zone (130) which is extended between the rear side (3) of said fan (1) and the third face (11) of said ring (9).

2. Fan (1) according to claim 1, wherein each said blade (8) is provided with a first recess edge (181), which is extended from the external edge (17) of said blade (8) towards the rotation axis (X) of said fan (1), wherein said recess (18) is extended from the rear edge (15) of said blade (8) to said first recess edge (181) on which the fourth face (12) of said ring (9) is fixed.

3. Fan (1) according to claim 2, wherein each said blade (8) is provided with a second recess edge (182), which is extended from said rear edge (15) until it is joined to said first recess edge (181), wherein recess (18) is extended from the external edge (17) of said blade (8) to said second recess edge (182).

4. Fan (1) according to claim 3, wherein said first recess edge (181) is joined to said second recess edge (182) in an internal vertex of said recess (18).

5. Fan (1) according to claim 1, wherein said recess (18) is arranged as a connection between the external edge (17) and the rear edge (15) of said blade (8).

6. Fan (1) according to claim 1, wherein said recess (18) is shaped as a step.

7. Fan (1) according to claim 1, wherein each said blade (8) is provided, at the corresponding said recess (18), with at least one first bent fin (81) fixed on the fourth face (12) of said ring (9).

8. Fan (1) according to claim 1, wherein said ring (9) is arranged closer to said support plate (5) than the internal edge (16) of each said blade (8).

9. Fan (1) according to claim 1, wherein said ring (9) intercepts the external edge (17) of each said blade (8).

10. Fan (1) according to claim 1, wherein said support plate (5) is provided with a perimeter profile (50) having a first external diameter (D1), and said ring (9) is provided with an internal profile (93) which delimits an internal opening (94) and has an internal diameter (D3) greater than or equal to the first external diameter (D1) of the perimeter profile (50) of said support plate (5).

11. Fan (1) according to claim 10, wherein the internal diameter (D3) of the internal profile (93) of said ring (9) is equal to the first external diameter (D1) of the perimeter profile (50) of said support plate (5).

12. Fan (1) according to claim 1, wherein the external edge (17) of each said blade (8) is provided with an outflow concavity (19).

13. Oven (100) which comprises:

a support structure (102) which encloses a cooking chamber (103);

a heating device (110) mounted on said support structure (102), operatively associated with said cooking chamber (103), and actuatable for heating air inside said cooking chamber (103);

a fan (1) according to claim 1 which is arranged within said cooking chamber (103), and is actuatable for generating, within said chamber (103), a recirculation air flow adapted to distribute hot air within said cooking chamber (103);

a vapor production device (111) arranged frontally with respect to said fan (1) and adapted to spray a quantity of water on the blades (8) of said fan (1);

a sensor arranged in the non-interference zone (130) of said fan (1) behind said ring (9), in a manner such that said ring (9) is configured for intercepting the water coming from said vapor production device (111), protecting said non-interference zone (130) and preventing the water from coming into contact with said sensor.

* * * * *